US007690384B2

(12) United States Patent
Wada et al.

(10) Patent No.: US 7,690,384 B2
(45) Date of Patent: Apr. 6, 2010

(54) CIGARETTE MAKING APPARATUS

(75) Inventors: Syuji Wada, Tokyo (JP); Takahiro Oba, Tokyo (JP); Takafumi Izumiya, Tokyo (JP); Junichi Nagai, Tokyo (JP); Narimasa Kaneda, Tokyo (JP); Manabu Yamada, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 383 days.

(21) Appl. No.: 11/896,495

(22) Filed: Aug. 31, 2007

(65) Prior Publication Data

US 2008/0047569 A1 Feb. 28, 2008

Related U.S. Application Data

(63) Continuation of application No. PCT/JP2005/018566, filed on Oct. 6, 2005.

(30) Foreign Application Priority Data

Mar. 2, 2005 (JP) ..... 2005-057726

(51) Int. Cl.
*A24C 1/34* (2006.01)

(52) U.S. Cl. ..... 131/35; 131/37; 131/909

(58) Field of Classification Search ..... 131/35, 131/37, 909

See application file for complete search history.

(56) References Cited

U.S. PATENT DOCUMENTS 2,543,277 A * 2/1951 Copeman ..... 131/61.1
2,823,640 A * 2/1958 Whitbeck ..... 118/64
4,132,189 A * 1/1979 Greve et al. ..... 118/674
4,567,752 A * 2/1986 Labbe ..... 73/37.6
4,575,368 A * 3/1986 Sagawa et al. ..... 493/49
5,797,406 A * 8/1998 Dawson ..... 131/84.1
7,243,656 B2 * 7/2007 Kushihashi et al. ..... 131/60
7,275,548 B2 * 10/2007 Hancock et al. ..... 131/35
7,276,120 B2 * 10/2007 Holmes ..... 118/325
7,300,394 B2 * 11/2007 Buhl et al. ..... 493/46
7,363,929 B2 * 4/2008 Fagg et al. ..... 131/35
2004/0118416 A1 6/2004 Seymour et al.
2005/0076925 A1 * 4/2005 Fagg et al. ..... 131/60

(Continued)

FOREIGN PATENT DOCUMENTS

EP 1 421 863 A1 5/2004

(Continued)

*Primary Examiner*—Carlos Lopez
(74) *Attorney, Agent, or Firm*—Birch, Stewart, Kolasch & Birch LLP

(57) ABSTRACT

A cigarette making apparatus comprises an application nozzle for applying a flavoring material to a wrapping-paper web supplied continuously to a wrapping machine, a pump for supplying the flavoring material to the application nozzle, and a pump control device for controlling the pump driving speed depending on the wrapping machine operating speed. The pump control device divides the wrapping machine operating speed into a plurality of speed regions and determines an approximation pump characteristic which approximates a relationship between the pump driving speed and the rate of discharge of the flavoring material from the pump in each of the speed regions, in advance, and determines the speed at which the pump should be driven, depending on the wrapping machine operating speed, according to the approximation pump characteristic. Consequently, the flavoring material is applied to the wrapping-paper web in an appropriate amount depending on the wrapping machine operating speed.

3 Claims, 2 Drawing Sheets

U.S. PATENT DOCUMENTS

| | | | | |
|---|---|---|---|---|
| 2006/0207617 | A1* | 9/2006 | Seymour et al. | 131/284 |
| 2006/0252622 | A1* | 11/2006 | Kato | 493/39 |
| 2008/0288346 | A1* | 11/2008 | Shames | 705/14 |
| 2009/0183836 | A1* | 7/2009 | Riedel | 156/379.6 |

FOREIGN PATENT DOCUMENTS

| | | | |
|---|---|---|---|
| JP | 2002-146386 | A | 5/2002 |
| JP | 2004-105799 | A | 4/2004 |
| RU | 2 109 468 | C1 | 4/1998 |
| RU | 2 214 142 | C2 | 5/2003 |
| SU | 1836039 | A3 | 8/1993 |
| WO | WO-03/013284 | A1 | 2/2003 |
| WO | WO-2004/064546 | A1 | 8/2004 |

* cited by examiner

CIGARETTE MAKING APPARATUS

TECHNICAL FIELD

This invention relates to a cigarette making apparatus for manufacturing cigarettes, applying a flavoring material to a wrapping-paper web continuously supplied to a wrapping machine.

BACKGROUND ART

A wrapping machine used in manufacture of cigarettes is presented in detail in published U.S. Patent Application No. 2004/0118416 A1. In this wrapping machine, a wrapping-paper web continuously supplied is supported and conveyed lengthways by a garniture tape, and on the upper side of this wrapping-paper web, a controlled amount of shredded tobacco is disposed. Then, by continuously wrapping the shredded tobacco in the wrapping-paper web by bending both sides of the wrapping-paper web, a continuous tobacco rod is continuously formed. During this process, seam glue for sticking the opposite side ends of the wrapping-paper web wrapped around the shredded tobacco together is applied to one side end of the wrapping-paper web continuously supplied to the wrapping machine.

International Patent Publication No. 2004/064546 discloses application of a flavoring material for suppressing a particular smell of cigarettes without harming the taste thereof, to a wrapping-paper web. The flavoring material of this type is, for example in a form mixed with a CMC (carboxymethylcellulose) aqueous solution or a benzine alcohol suspension. The amount of the flavoring material applied to the wrapping-paper web is great, compared with the seam glue. Further, the amount of the flavoring material applied to the wrapping-paper web affects the quality of the cigarettes manufactured. Thus, it is necessary to control the amount of the flavoring material applied, accurately.

Meanwhile, the speed of supply of the wrapping-paper web to the wrapping machine is varied depending on the operating speed of the wrapping machine, namely the speed at which the wrapping machine forms a continuous tobacco rod. Thus, when the flavoring material is applied to the wrapping-paper web while the continuous tobacco rod is being formed, it is important to adjust the rate of supply of the flavoring material to an application nozzle depending on the traveling speed of the wrapping-paper web (speed of supply of the wrapping-paper web) so that the flavoring material will be applied to the wrapping-paper web in a fixed amount per unit area. Conventionally, the rate of supply of the flavoring material to the application nozzle is controlled by controlling the rotating speed of a pump which supplies the flavoring material to the application nozzle, depending on the operating speed of the wrapping machine. However, even when the rotating speed of the pump is controlled depending on the operating speed of the wrapping machine, variations in operating speed of the wrapping machine still produce some variations in cigarette quality.

DISCLOSURE OF THE INVENTION

Through studies about the cause of such variations in the amount per unit area of the flavoring material applied, the inventors found out that the rate of supply of the flavoring material from the pump to the application nozzle (rate of discharge from the pump) is not proportional to the rotating speed of the pump in the entire range of rotating speeds, and that the amount of the flavoring material discharged from the pump in one cycle varies depending on the rotating speed of the pump. This is thought to be due to the viscosity of the flavoring material, etc.

The primary object of this invention is to provide a cigarette making apparatus which can apply a flavoring material to a wrapping-paper web continuously supplied to a wrapping machine for forming a continuous tobacco rod, in an appropriate amount depending on the operating speed of the wrapping machine, thereby stabilizing the quality of cigarettes manufactured.

A cigarette making apparatus according to the present invention comprises a wrapping machine for continuously wrapping shredded tobacco in a wrapping-paper web by bending both sides of the wrapping-paper web; a wrapping-paper web feed device for continuously supplying the wrapping-paper web to the wrapping machine at speed depending on operating speed of the wrapping machine; an application nozzle for applying a flavoring material to the wrapping-paper web, provided in a wrapping-paper web feed path extending from the wrapping paper feed device to the wrapping machine, as a stage prior to applying seam glue to the wrapping-paper web; a pump for supplying the flavoring material to the application nozzle; and a pump control device for controlling the speed at which the pump is driven, depending on the operating speed of the wrapping machine.

The pump control device divides the operating speed of the wrapping machine into a plurality of speed regions and determines an approximation pump characteristic which approximates a relationship between the speed at which the pump is driven and the rate of discharge of the flavoring material from the pump in each of the speed regions, in advance, and determines the speed at which the pump should be driven, depending on the operating speed of the wrapping machine, according to the approximation pump characteristic.

Desirably, the pump control device should determine a linear approximation pump characteristic for a rated operating-speed region of the wrapping machine by obtaining, for a plurality of operating speeds within the rated operating-speed region, the pump driving speed which produces such supply of the flavoring material to the application nozzle that produces the application of the flavoring material to the wrapping-paper web in a fixed amount per unit area, and determine a linear approximation pump characteristic for a region below the rated operating-speed region of the wrapping machine to give "0" when the wrapping machine is at rest and meet the linear approximation characteristic for the rated operating-speed region at the lowest rated operating speed. The pump control device obtains the speed at which the pump should be driven, depending on the operating speed of the wrapping machine, according to these linear approximation characteristics, and performs control according to the pump driving speed obtained.

The flavoring material is prepared, for example by mixing power containing a flavoring substance with a CMC (carboxymethylcellulose) aqueous solution or a benzine alcohol suspension.

In the present invention, in order to control the rate of supply of the flavoring material to the application nozzle for applying the flavoring material to the wrapping-paper web continuously supplied to the wrapping machine depending on the operating speed of the wrapping machine, an approximation pump characteristic which approximates a relationship between the speed at which the pump is driven and the rate of supply (discharge) of the flavoring material from the pump to the application nozzle is determined in advance, and the speed at which the pump should be driven is determined, depending on the operating speed of the wrapping machine, according to the approximation pump characteristic. Consequently, the flavoring material can be stably applied to the wrapping-paper web in a fixed amount per unit area, in spite of variations in the speed of supply of the wrapping-paper web, without being affected by the viscosity of the flavoring material, etc.

The pump control device controls the operation of the pump to supply the flavoring material to the application nozzle at a rate depending on the operating speed of the wrapping machine and hence depending on the speed of supply of the wrapping-paper web, by effectively compensating for variations in pump operating characteristic caused by the viscosity of the flavoring material, etc. This allows the application nozzle to always stably apply the flavoring material to the wrapping-paper web in a fixed amount per unit area, although the amount of the flavoring material applied is great, compared with seam glue.

When a common rotary pump is used, there is a tendency such that in a high rotating-speed region of the pump, the rate of application of the flavoring material is approximately proportional to the rotating speed of the pump, while in a low rotating-speed region, the rate of discharge of the flavoring material increases steeply, compared with the rotating speed of the pump. Thus, for a region below the rated operating-speed region of the wrapping machine, a linear approximation pump characteristic is determined to give "0" when the wrapping machine is at rest and meet the linear approximation pump characteristic for the rated operating-speed region at the lowest rated operating speed. This allows the control system to function stably, in a simple and reasonable manner. This leads to advantages such that the quality of cigarettes manufactured can be improved by stably controlling the operation of the pump for supplying the flavoring material to the application nozzle, without constructing a complicated control system.

BEST MODE OF CARRYING OUT THE INVENTION

Figure 1:
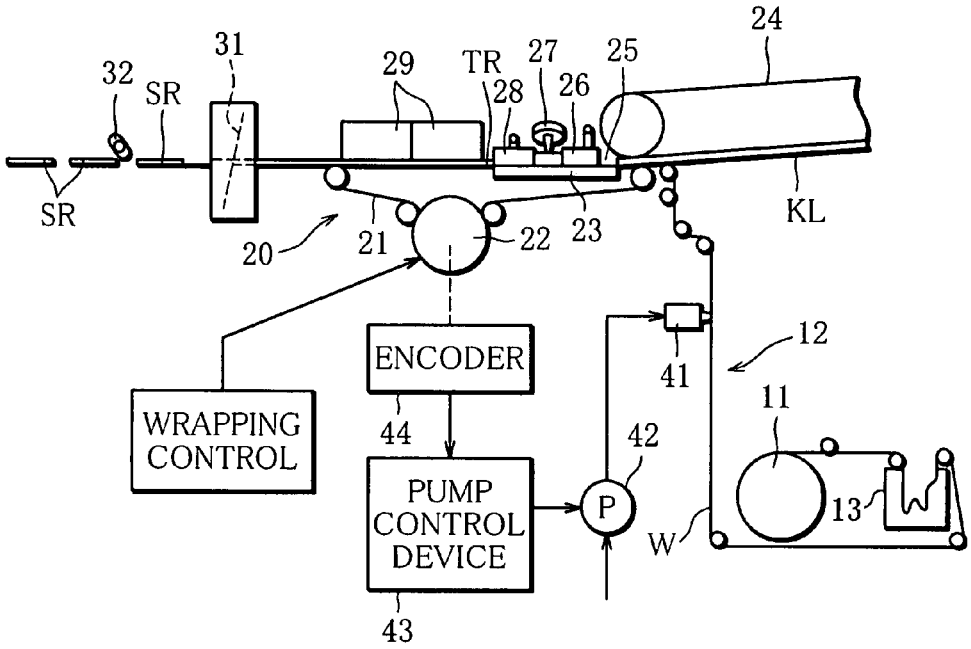
[FIG. 1] A diagram showing schematic structure of an embodiment of cigarette making apparatus according to the present invention.

Referring to the drawings, an embodiment of cigarette making apparatus according to the present invention will be described below.

FIG. 1 shows a schematic structure of a cigarette making apparatus. A roll 11 of a wrapping-paper web W of a determined width is provided to the cigarette making apparatus so that the wrapping-paper web W is fed from the roll 11 along a feed path 12. The feed path 12 is defined by a plurality of guide rollers 13, and the terminal end of the feed path 12 is adjacent to the entry of a wrapping machine 20. The feed path 12 includes feed rollers (not shown) and a reservoir 13. The reservoir 13 is provided for "buffering", namely storing a determined length of the wrapping-paper web W to give time for joining a wrapping-paper web W of a subsequent roll 11 to the previous wrapping-paper web W.

The wrapping machine 20 includes an endless garniture tape 21. The wrapping-paper web W is fed from the terminal end of the feed path 12 to the garniture tape 21, continuously. The garniture tape 21 is passed around a drive drum 22 to form a round path. As the drive drum 22 rotates, the garniture tape travels with the wrapping-paper web W, in a forming groove (not shown) in a forming bed 23, in one direction. The forming groove in the forming bed 23 has a shape such that it gradually decreases in width and radius of curvature of the bottom, from the entry to the exit of the wrapping machine, and has an approximately half-round cross-section at the exit of the wrapping machine 20.

At the entry of the wrapping machine 20, shredded tobacco K is supplied onto the upper side of the wrapping-paper web W. More specifically, shredded tobacco K is sucked onto the lower side of an endless tobacco band 24 to form a shredded tobacco layer KL, which is conveyed to the entry of the wrapping machine 20 as the tobacco band 24 travels. The shredded tobacco layer KL retained on the tobacco band 24 by suction is taken off the tobacco band 24 and transferred onto the wrapping-paper web W by a tong shoe 25 disposed at the entry of the wrapping machine 20.

After the shredded tobacco layer KL is supplied onto the wrapping-paper web W in this manner, the wrapping-paper web W with the shredded tobacco layer KL on is conveyed into the wrapping machine 10, and passes though the tong shoe 25, a short holder 26, a glue application nozzle 27 and a long holder 28, which are provided in the wrapping machine, successively. In this process, the shredded tobacco K is wrapped in the wrapping-paper web W so that a continuous tobacco rod TR is formed continuously. The tobacco rod TR formed is sent out from the exit of the wrapping machine 10.

More specifically, the tong shoe 25 compresses the shredded tobacco layer KL from above, thereby forming it to describe an arc in cross-section, while the forming groove in the forming bed 23 bends the wrapping-paper web into a U-like cross-section, from below, with the garniture tape 21. Thus, the shredded tobacco layer KL is compressed from above and from below, and thereby formed to describe upper and lower arcs in cross-section. The short holder 26 bends one side of the wrapping-paper web W into an arc, with the garniture tape 21, so that one half of the upper half of the shredded tobacco layer KL is covered with this part of the wrapping-paper web. At this time, the glue application nozzle 27 applies seam glue to the other side end of the wrapping-paper web W. Then, the long holder 28 bends this other side of the wrapping-paper web W into an arc, with the garniture tape 21, so that the other half of the upper half of the shredded tobacco layer KL is covered with this part of the wrapping-paper web W. Consequently, one side end of the wrapping-paper web W comes on the other side end and they are stuck together by the seam glue, so that the tobacco rod TR is formed.

The tobacco rod TR sent out from the exit of the wrapping machine 20 passes under a heater 29, where the seam glue is dried. Then, the tobacco rod TR is cut by a rotary knife 31 in a cutting section, into cigarette rods SR of a determined length, namely twice the length of a cigarette. The cigarette rods SR are supplied to the next stage (next step), namely a filter attachment machine (not shown) by a kicker 32.

In the filter attachment machine, one cigarette rod SR is cut into two cigarettes, and a filter plug is disposed between the two cigarettes, coaxially. Then a tip paper piece is wrapped around them to cover the filter plug and the adjacent ends of the cigarettes, so that the two cigarettes and filter plug are joined together to form a double filter-cigarette. Then, by cutting the double filter-cigarette at the center of the filter plug, into two equal parts, two filtered cigarettes are formed.

In the cigarette making apparatus basically having the above-described configuration, a flavoring-material application device for applying a flavoring material to the wrapping-paper web W is disposed, for example on the feed path 12, downstream of the reservoir 13, as a stage prior to the application of the seam glue. The flavoring-material application device includes an application nozzle 41 for applying a flavoring material in liquid form to the inside surface of the wrapping-paper web W, with a determined width, and a pump 42 for supplying the flavoring material to the application nozzle 41.

The application nozzle 41 applies the flavoring material linearly by discharging the flavoring material from the distal end of the nozzle onto the surface of the wrapping-paper web W intended for application of the flavoring material. The rate of discharge of the flavoring material from the application nozzle 41 is controlled by the rate of supply of the flavoring material from the pump 42. The rate of supply of the flavoring material is controlled by the pump 42 driving speed controlled by a pump control device 43, or in other words, the rotating speed of the pump 42. Specifically, the pump control device 43 controls the rate of supply of the flavoring material to the application nozzle 41 and hence the rate of application of the flavoring material to the wrapping-paper web W, by receiving output of an encoder 44 for detecting the rotating speed of the drive drum 22, and controlling the rotating speed of the pump 42 depending on the speed at which the wrapping machine 20 forms the tobacco rod, or in other words, the operating speed of the wrapping machine 20, as described later.

The flavoring material (flavoring mixture) applied to the wrapping-paper web W in the above-described manner is, for example for alleviating or masking an unpleasant smell of a cigarette smoked, smell of sidestream smoke, in particular. Specifically, the flavoring material contains one or more flavoring substances selected from a group consisting of terpenes, esters, alcohols such as linalool, nerol and geraniol, phenols such as anethole, aldehydes such as vanillin and ethyl vanillate, lactones, plant extracts, fruit extracts, etc. The flavoring material may contain any of substances as disclosed in Japanese Unexamined Patent Publication No. 2002-146386. The flavoring material is prepared, for example by mixing powder containing a flavoring substance as mentioned above with a CMC (carboxymethylcellulose) aqueous solution or a benzine alcohol suspension. Specifically, a flavoring material prepared by mixing flavoring powdered capsules with an approximately 80 weight % CMC alcohol aqueous solution or a benzine alcohol suspension.

Next, the pump 24 driving speed control (rotating speed control) performed by the pump control device 43 will be described. The speed at which the wrapping-paper web W is continuously supplied (conveyed) to the wrapping machine 20 varies depending on the speed at which the wrapping machine 20 forms the tobacco rod. The pump control device 43 has a function of applying the flavoring material to the wrapping-paper web W in a fixed amount per unit area, in spite of variations in the speed at which the wrapping-paper web W is supplied (conveyed). Roughly speaking, the pump control device 43 keeps the amount per unit area of the flavoring material applied to the wrapping-paper web W by the application nozzle 41 constant, by increasing the rate of supply of the flavoring material to the application nozzle 41 twofold when the speed at which the wrapping machine forms the tobacco rod increases twofold.

However, as mentioned above, the intended purpose, namely "keeping the amount per unit area of the flavoring material applied to the wrapping-paper web W constant" is not always achieved, when the rotating speed of the pump 42 (pump driving speed) is controlled simply in proportion to the operating speed of the wrapping machine 20 detected by the encoder 44. In order to find out the cause of this, the inventors varied the speed at which the wrapping machine 20 formed the tobacco rod (operating speed of the wrapping machine in terms of the rotating speed of the drive drum), and adjusted the rotating speed of the pump 41 so that the application nozzle 41 would discharge the flavoring material at the rate (discharge rate) proportional to the varying tobacco-rod formation speed. The result obtained is as below:

TABLE 1

| Wrapping machine operating speed (cpm) | Standard discharge (g/30 sec) | Measured discharge (g/30 sec) | Pump rotating speed (cpm) | Discharge per cycle (g) |
|---|---|---|---|---|
| 500 | 0.72 | 0.72 | 2.41 | 0.5975 |
| 1500 | 2.16 | 2.16 | 8.43 | 0.5180 |
| 2500 | 3.60 | 3.62 | 15.31 | 0.4733 |
| 3500 | 5.04 | 5.05 | 22.41 | 0.4510 |
| 4500 | 6.48 | 6.48 | 28.71 | 0.4514 |
| 5500 | 7.92 | 7.92 | 36.21 | 0.4373 |
| 6500 | 9.36 | 9.35 | 43.71 | 0.4278 |
| 7500 | 10.80 | 10.81 | 51.76 | 0.4176 |
| 8500 | 12.24 | 12.25 | 59.81 | 0.4096 |
| 9500 | 13.68 | 13.68 | 68.31 | 0.4005 |

Figure 2:
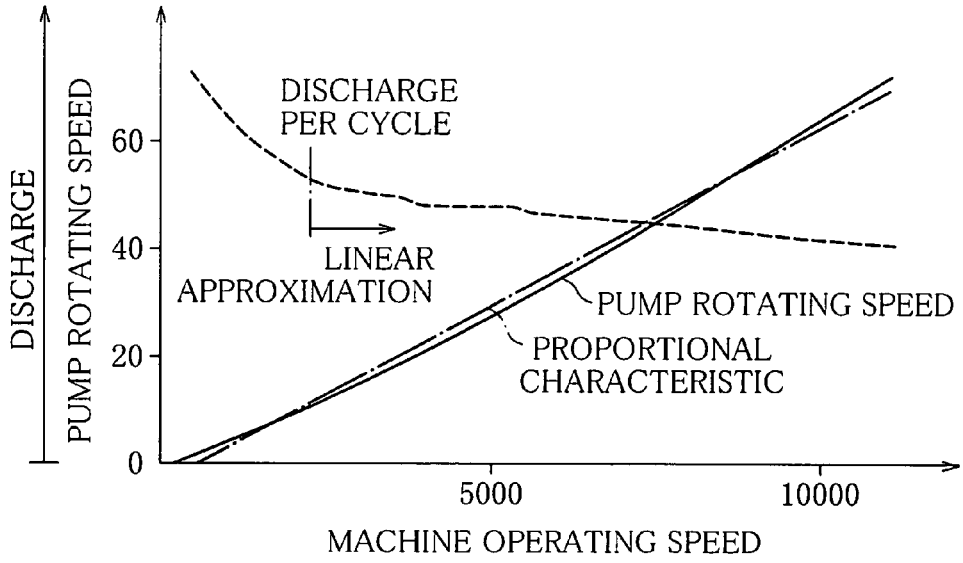
[FIG. 2] A diagram showing how the rotating speed of a pump and the discharge of a flavoring material from the pump are related to the operating speed of a wrapping machine.

FIG. 2 shows this experiment result in the form of a graph. The graph of FIG. 2 clearly shows that the rotating speed of the pump 42 is not proportional to the operating speed of the wrapping machine 42 in the entire range of operating speeds, and that the discharge per cycle of the pump 42 varies depending on the rotating speed of the pump. It was found out that in a high rotating-speed region of the pump 42, the discharge per cycle gradually decreases with increase of the rotating speed, while in a low operating-speed region, the discharge per cycle steeply increases with decrease of the rotation speed. This is thought to be exclusively due to the viscosity of the flavoring material, rather than the operating characteristics of the pump 42.

Figure 3:
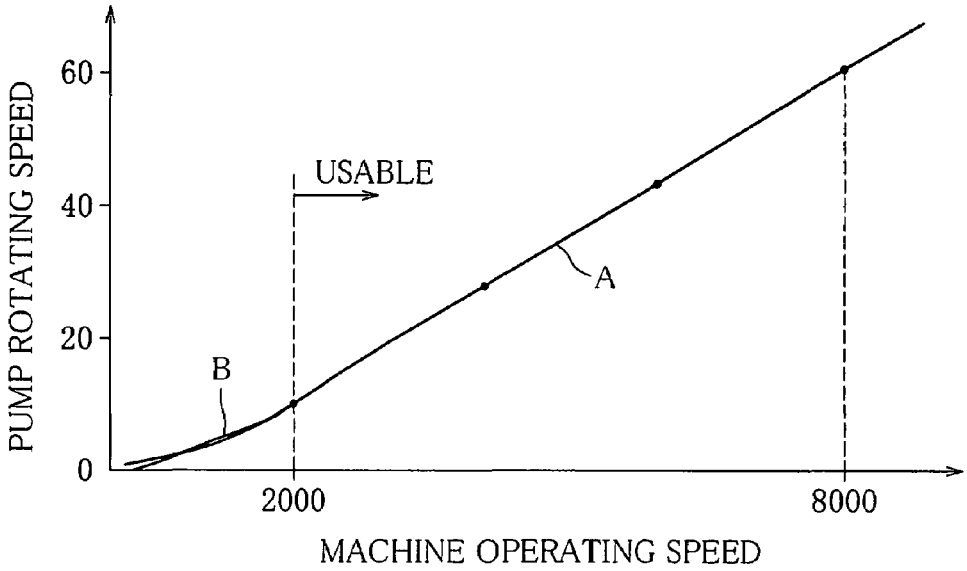
[FIG. 3] A diagram showing an approximation characteristic for pump rotating speed relative to machine operating speed.

Thus, in this cigarette making apparatus, the pump control device 43 is arranged to control the driving of the pump 42, depending on the operating speed of the wrapping machine, according to an approximation pump characteristic as shown in FIG. 3, which approximates the capacity of the pump 42 to discharge the flavoring machine obtained in the above-described manner. Specifically, the operating speed of the wrapping machine 20 is divided into a plurality of speed regions, and an approximation pump characteristic which approximates a relationship between the pump 42 driving speed and the rate of discharge of the flavoring material from the pump 42 in each speed region is obtained, so that a speed at which the pump 42 should be driven at a given operating speed of the wrapping machine 42 is obtained according to the approximation pump characteristic obtained.

The tobacco-rod formation by the wrapping machine 20 is normally carried out in a high operating-speed region above 1000 to 2000 cpm. In this high operating-speed region, the rate of discharge of the flavoring material is almost proportional to the pump 42 driving speed. Thus, in the present invention, a straight line which approximates the relationship between the machine operating speed and the pump rotating speed is determined as shown in FIG. 3. For example, for rated operating speeds 4500 cpm, 6500 cpm and 8500 cpm of the wrapping machine 20, pump rotating speeds which produce an intended flavoring-material discharge are obtained, and a straight line connecting the three points representing these three sets of values is obtained as a linear approximation characteristic A representing the relationship between the machine operating speed and the pump rotating speed. For a low operating-speed region, a liner approximation characteristic (correction function) B is determined to meet the linear approximation characteristic A at the lowest rated operating speed and give "0" when the wrapping machine is at rest. This is to prevent a problem (absurdity) such that a negative rotating speed of the pump 42 is given when the wrapping machine 20 is activated (started up).

Figure 4:
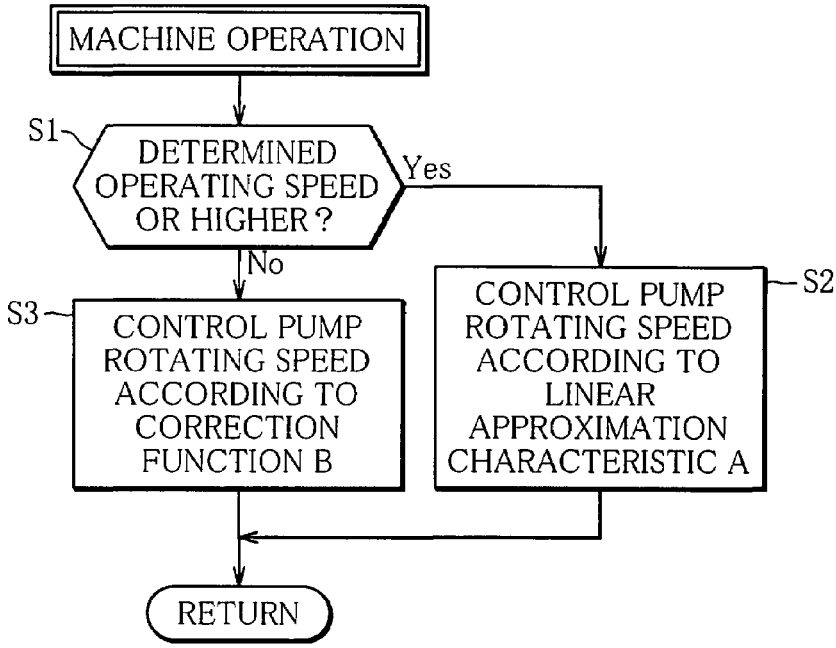
[FIG. 4] A diagram showing an example of a pump control process in the cigarette making apparatus shown in FIG. 1.

The pump control device 43 controls the pump 42 driving speed (rotating speed), for example according to a control process shown in FIG. 4. When the wrapping machine 20 is operating, the operating speed thereof is detected by the encoder 44 and whether or not the operating speed detected is within a high operating-speed region of a predetermined operating speed and higher is determined ⟨Step S1⟩. When the machine operating speed is within the high operating-speed region which can result in acceptable cigarettes, the pump rotating speed corresponding to the machine operating speed is obtained from the linear approximation characteristic A, and according to the pump rotating speed obtained, the driving of the pump 42 is controlled ⟨Step S2⟩. When the machine operating speed is low, the pump rotating speed corresponding to the machine operating speed is obtained from the correction function B, and according to the pump rotating speed obtained, the driving of the pump 42 is controlled ⟨Step S3⟩.

Desirably, the threshold value (predetermined operating speed) for evaluation of the machine operating speed should be the allowable lower limit, namely the limit below which the rate of discharge of the flavoring material is abnormal, which leads to rejection of cigarettes manufactured by the wrapping machine 20. Further, desirably, the linear approximation characteristic A should be determined such that the most accurate amount per unit area of the flavoring material application can be obtained at a standard rated operating speed of the wrapping machine 20, for example 8500 cpm.

In the cigarette making machine arranged such that the rate of application (discharge) of the flavoring material from the application nozzle 41 to the wrapping-paper web W is controlled by controlling the pump 42 driving speed in the above-described manner, a fixed amount per unit area of the flavoring material can be applied to the wrapping-paper web W, or in other words, the amount per unit area of the flavoring material applied to the wrapping-paper web W can be stably kept constant, in spite of variations in the tobacco-rod formation speed, without being affected by properties of the flavoring material, such as viscosity. In addition, only by controlling the pump 42 driving speed (rotating speed), depending on the operating speed of the wrapping machine 20, according to the linear approximation characteristic, the amount per unit area of the flavoring material applied can easily, accurately and stably be controlled to be constant. Thus, the quality of cigarettes manufactured can be stabilized effectively.

The present invention is not limited to the above-described embodiment. For example, although in the example described, the flavoring material is applied to the wrapping-paper web P in the pattern of a longitudinal line, the present invention is applicable to the case where the flavoring material is applied to the wrapping-paper web in the pattern of two or more longitudinal lines with a determined space between. Further, although the example in which single wrapper cigarettes, namely cigarettes with one wrapper W enclosing shredded tobacco K, are manufactured has been taken, the present invention is applicable to the manufacture of double wrapper cigarettes, namely cigarettes with two wrappers W enclosing shredded tobacco K, likewise. In the case of the double wrapper cigarettes, it can be arranged such that the flavoring material is applied between the two layered wrappers W, namely on the inside, or joint surface of one of the two layered wrappers W.

Regarding the approximation pump characteristic, the present invention may be modified to obtain the rotating speed of the pump 42 to compensate for variation in the amount of the flavor material discharged in one cycle of the pump 42, and control the pump 42 driving speed according to the rotating speed obtained. Further, although the example in which a common rotary pump is used has been taken, the present invention is applicable to the case where a piston-type pump is used, likewise. Regarding the flavoring material, a variety of types can be used according to the purpose. In other respects, the present invention can be modified in various ways, without deviating from its scope.

The invention claimed is:

1. A cigarette making apparatus comprising a wrapping machine for continuously wrapping shredded tobacco in a wrapping-paper web by bending both sides of the wrapping-paper web; a wrapping-paper web feed section for continuously supplying the wrapping-paper web to the wrapping machine at speed depending on operating speed of the wrapping machine; an application nozzle for applying a flavoring material to the wrapping-paper web, provided as a stage prior to applying seam glue to the wrapping-paper web supplied to the wrapping machine; a pump for supplying the flavoring material to the application nozzle; and a pump control device for adjusting rate of supply of the flavoring material to the application nozzle by controlling the speed at which the pump is driven, depending on the operating speed of the wrapping machine, wherein the pump control device divides the operating speed of the wrapping machine into a plurality of speed regions and determines an approximation pump characteristic which approximates a relationship between the speed at which the pump is driven and the rate of discharge of the flavoring material from the pump in each of the speed regions, in advance, and determines the speed at which the pump should be driven, depending on the operating speed of the wrapping machine, according to said approximation pump characteristic.

2. The cigarette making apparatus according to claim 1, wherein the pump control device determines a linear approximation pump characteristic for a rated operating-speed region of the wrapping machine by obtaining, for a plurality of operating speeds within said rated operating-speed region, the pump driving speed which produces such supply of the flavoring material to the application nozzle that produces the application of the flavoring material to the wrapping-paper web in a fixed amount per unit area, and determines a linear approximation pump characteristic for a region below said rated operating-speed region of the wrapping machine to give "0" when the wrapping machine is at rest and meet the linear approximation characteristic for the rated operating-speed region at the lowest rated operating speed.

3. The cigarette making apparatus according to claim 1, wherein the flavoring material is a liquid prepared by mixing powder containing a flavoring substance with a CMC (carboxymethylcellulose) aqueous solution or a benzine alcohol suspension.

* * * * *